US008631942B2

(12) United States Patent
Levy et al.

(10) Patent No.: US 8,631,942 B2
(45) Date of Patent: Jan. 21, 2014

(54) FOOD CONTAINER WITH MEDIA PLAYER

(75) Inventors: Joseph Levy, Augusta, GA (US); Marlon Carter, Waukesha, WI (US)

(73) Assignee: MJ Connection, LLC, Augusta, GA (US)

( * ) Notice: Subject to any disclaimer, the term of this patent is extended or adjusted under 35 U.S.C. 154(b) by 0 days.

(21) Appl. No.: 13/329,997

(22) Filed: Dec. 19, 2011

(65) Prior Publication Data

US 2012/0234704 A1 Sep. 20, 2012

Related U.S. Application Data

(60) Provisional application No. 61/424,080, filed on Dec. 17, 2010.

(51) Int. Cl.
*A45C 11/20* (2006.01)
*F25D 3/08* (2006.01)

(52) U.S. Cl.
USPC ..... 206/542; 62/457.7

(58) Field of Classification Search
USPC ..... 206/459.1, 541, 542, 545; 62/457.1–457.9; 381/332–336
See application file for complete search history.

(56) References Cited

U.S. PATENT DOCUMENTS 4,279,342 A * 7/1981 Van Pelt ..... 206/542
4,489,770 A * 12/1984 Reich, II ..... 381/334
4,939,912 A * 7/1990 Leonovich, Jr. ..... 62/457.1
5,235,822 A * 8/1993 Leonovich, Jr. ..... 62/457.2
5,447,041 A * 9/1995 Piechota ..... 62/457.7
5,500,636 A * 3/1996 Mitchell ..... 340/571
5,706,940 A * 1/1998 Amarello ..... 206/320
5,979,175 A * 11/1999 Ellison ..... 62/457.7
6,305,547 B1 * 10/2001 Curran ..... 206/459.1
6,347,706 B1 * 2/2002 D'Ambrosio ..... 206/459.1
7,806,271 B1 * 10/2010 Kraska ..... 206/542
2002/0179482 A1 * 12/2002 Castaneda et al. ..... 206/541
2006/0196218 A1 * 9/2006 Mogil et al. ..... 62/457.4
2009/0049859 A1 * 2/2009 Moon ..... 62/457.7

* cited by examiner

*Primary Examiner* — Bryon Gehman

(74) *Attorney, Agent, or Firm* — Thomas|Horstemeyer, LLP

(57) ABSTRACT

Embodiments of a food container including a media player are provided. In some embodiments, the food container has an exterior, and the food container comprises at least one compartment sized and dimensioned to accommodate food. Additionally, the food container includes a media player configured to play media content. The container and/or media player includes at least one device that serves as an input device to select media content in the media player of for later play and activation device to activate the play of the selected media content. In another embodiment the container and/or media player includes two devices, one to select media content and another to activate play of the selected media content. The media content can be, for example, a message from a parent or other meal maker to a child for later play by the child during the day.

16 Claims, 8 Drawing Sheets

FOOD CONTAINER WITH MEDIA PLAYER

CROSS-REFERENCE TO RELATED APPLICATION

This application claims priority to, and the benefit of, U.S. Provisional Patent Application entitled, "Food Container With Media Player," having Ser. No. 61/424,080, filed on Dec. 17, 2010, which is incorporated by reference in its entirety.

TECHNICAL FIELD

The present disclosure generally relates to food containers and more particularly, relates to portable food containers of the type typically used by children for taking food with them to a day program, for example to school or day care.

BACKGROUND

The conventional food container used by children to take food with them during the day to a daily activity, such as day care or school, is either a hard-sided or soft-sided container that may include a handle. Such a food container does not have any way for a parent to leave a message for the child other than by writing a note on a piece of paper and placing the note inside of the container.

There is a need to address the aforementioned deficiency and inadequacy to provide alternative means for leaving a message.

SUMMARY

The present disclosure addresses the aforementioned deficiency and inadequacy. Briefly described, one embodiment, among others, is a food container including a media player that enables playback of media content (e.g., a message). The food container can be either a soft-sided or a hard-sided container and includes at least one compartment that is sized and dimensioned to accommodate food. In an embodiment, the food container may include a second compartment to house a media player and a media player contained within the second compartment. Preferably, the second compartment is designed to be water-tight to prevent moisture from entering the compartment and thereby protect the media player from moisture that may damage the media player and also to protect the media player from any food stored in another compartment in the container. The second compartment may optionally be re-sealable to allow the media player to be removed if so desired or sealed to safely retain the media player within the sealed compartment. The food container may optionally include a handle for ease in carrying the container.

A parent or other meal maker would be able to use the container to provide media content that can be played later in the day by another person, such as by a meal eater. In one embodiment the media player allows a person having the container to play the media content. The media player can include pre-recorded media content from which the parent or other meal maker can select one or more of the pre-recorded media content for later play back. The media player can also include any one or more conventional means allowing the recording and play back of selected media content in which case either the container or the media player may include a microphone associated with the media player to allow the recording of a message. The media player can also include alternative voices such that a recorded message may be played in a voice other than that of the parent or other meal maker who recorded the message, for example allowing a message to be played in the voice of a favorite cartoon, TV or movie character.

In one embodiment, the food container and/or the media player includes an input/output device for selecting media content and also for activating play of the media content. The input/output device can be a multi-function button that allows the parent or other meal maker to select media content for play and also allows for later activation of the play of the selected media content. The input/output device can be included as a part of the media player or can be included as a part of the container separate from, but connected to, the media player.

The container further includes an output device for outputting media content. For example, the output device can be a speaker. The output device can also be an output jack into which a plug for ear phones can be inserted for listening to the media content, allowing for the media content to be listened to privately. The output device may also be a wireless device or system such as a Bluetooth® to allow wireless output of the media content to another device, such as a smartphone. Any one or more of such output devices can be included, or all can be included to allow a choice of modes for listening to the play of the selected media content.

In some embodiments, the container and/or the media player further includes at least one input device allowing for either the selection of a stored or pre-recorded media content or for activation of the recording of media content on the media player, an activation device to activate play of the media content, an output device to allow output of media content, and/or a display device to display the media content. The at least one input device, the media content activation device, the output device and/or the display may be included as a part of the media player or may be included as a part of the container separate from, but connected to, the media player.

In some embodiments, the media player includes a media recorder so that the meal maker is able to conveniently record the media content. The media content can include, for example, an audio file, a video file, and/or an audio/video file. In one embodiment, the media content is a message from the parent or other meal maker. The message can be, for example, a message about the meal, a message about some activity planned for the day or a reminder message, such as a reminder to take certain medication.

In a further embodiment, a method for playing media content is provided including the steps of providing a container, the container including a media player for playing media contents and selecting media content on the media player for play at a later time, wherein the media content comprises pre-recorded or stored media content or media content recorded by a user of the container. In one embodiment, the container is a food container and the media content is a message for play later in the day.

Other systems, methods, features, and advantages of the present disclosure for a food container with a media player will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
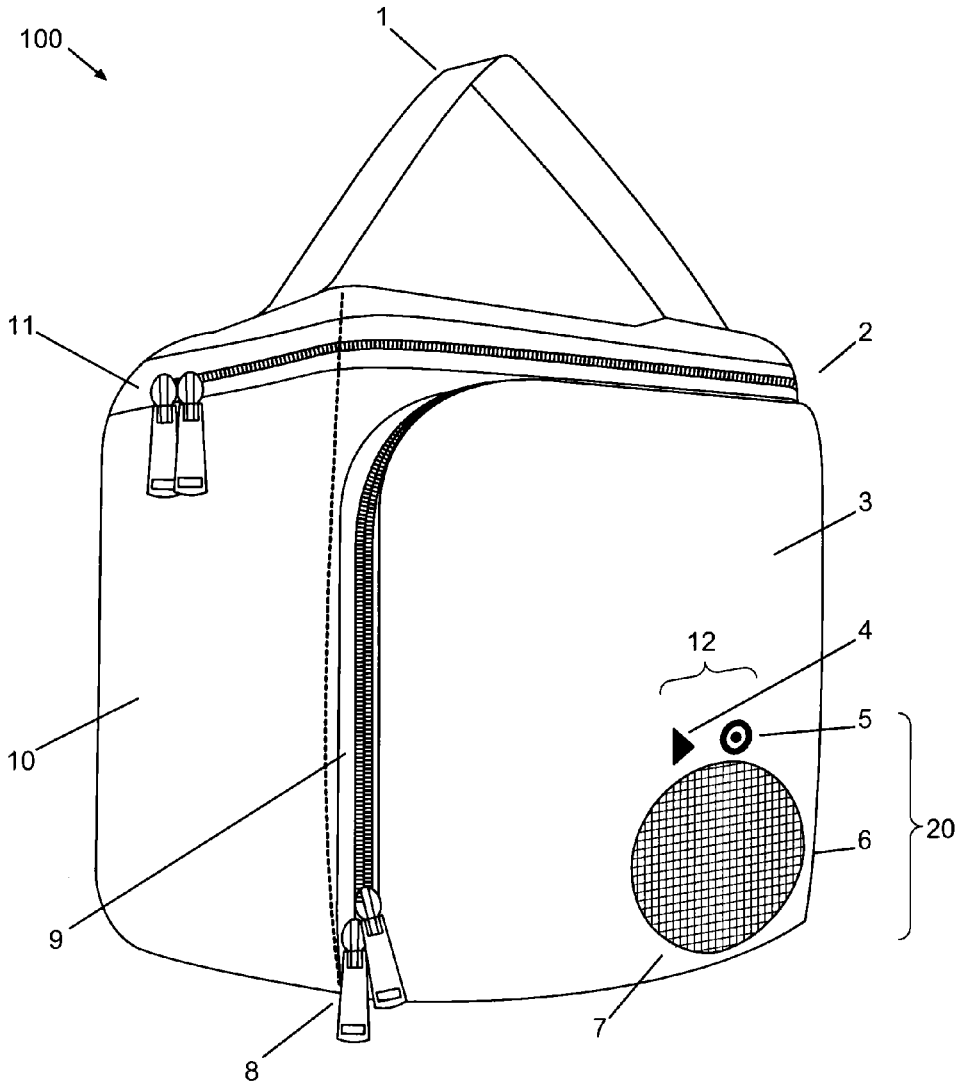
FIGS. 1A-C illustrate one embodiment of the present disclosure of a food container including a media player.

Having summarized various aspects of the present disclosure, reference will now be made in detail to the description of the disclosure as illustrated in the drawings. While the disclosure will be described in connection with these drawings, there is no intent to limit it to the embodiment or embodiments disclosed herein. On the contrary, the intent is to cover all alternatives, modifications and equivalents included within the spirit and scope of the disclosure as defined by the appended claims.

Figure 1B:
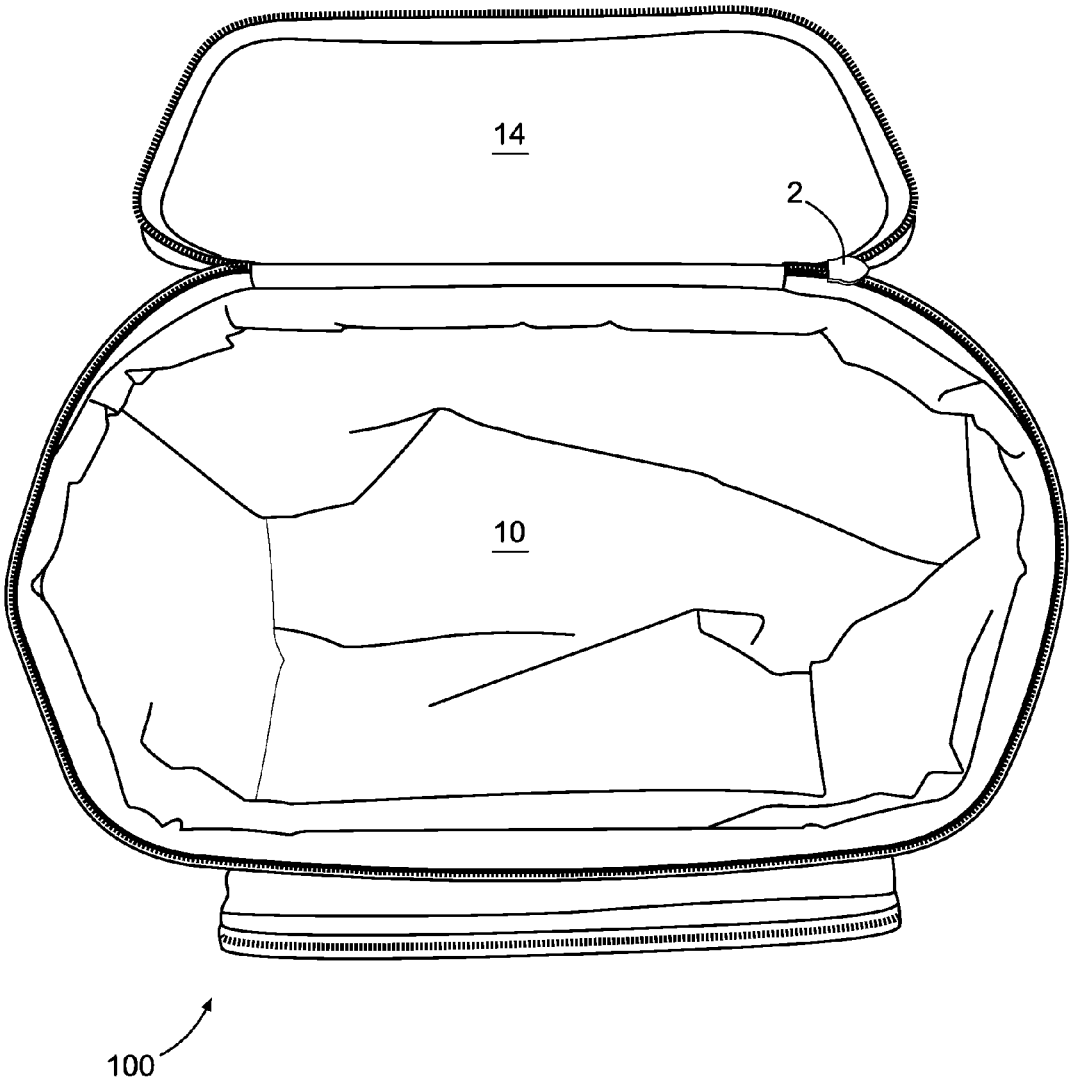
Figure 1C:
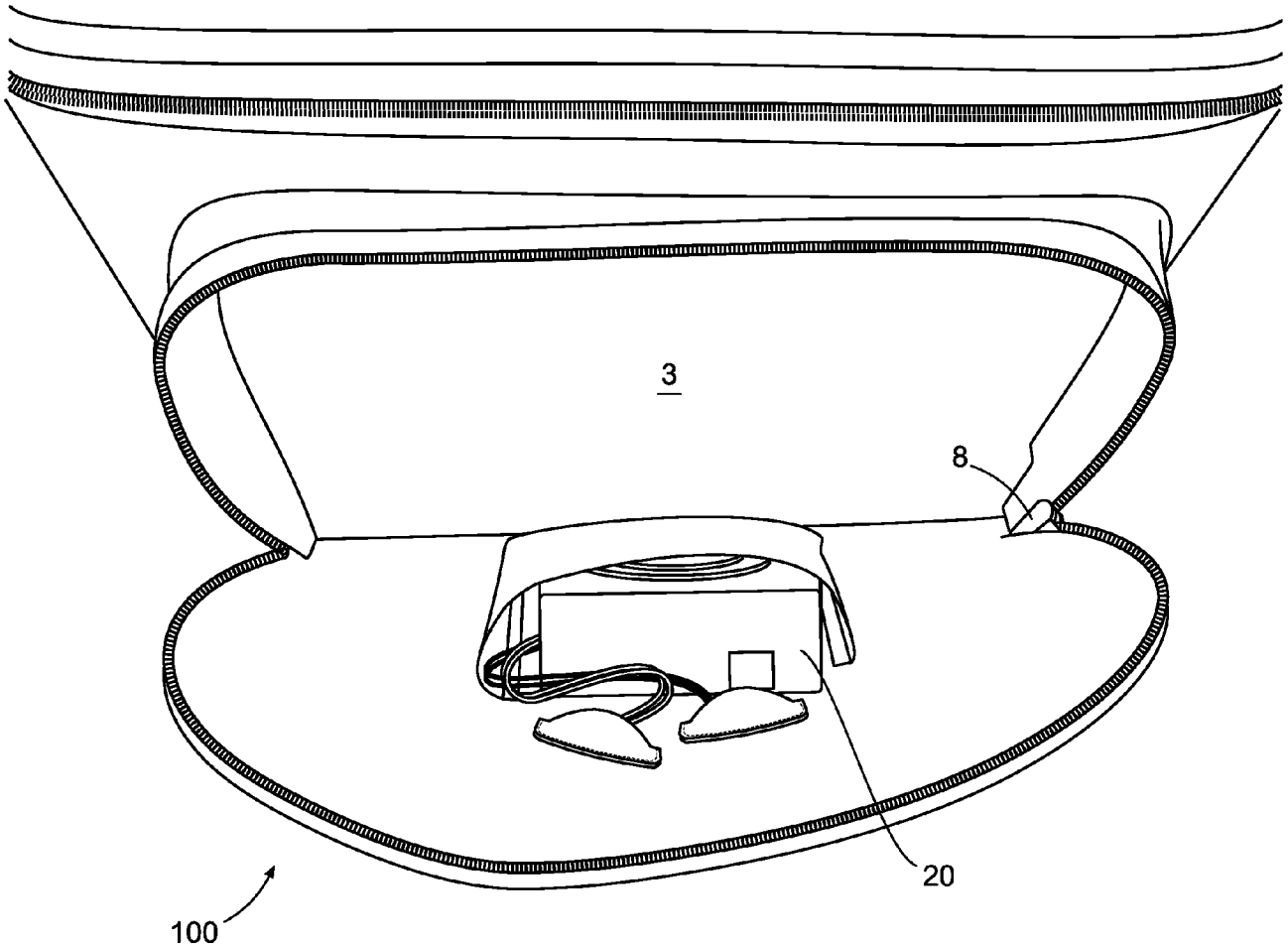
Figure 2:
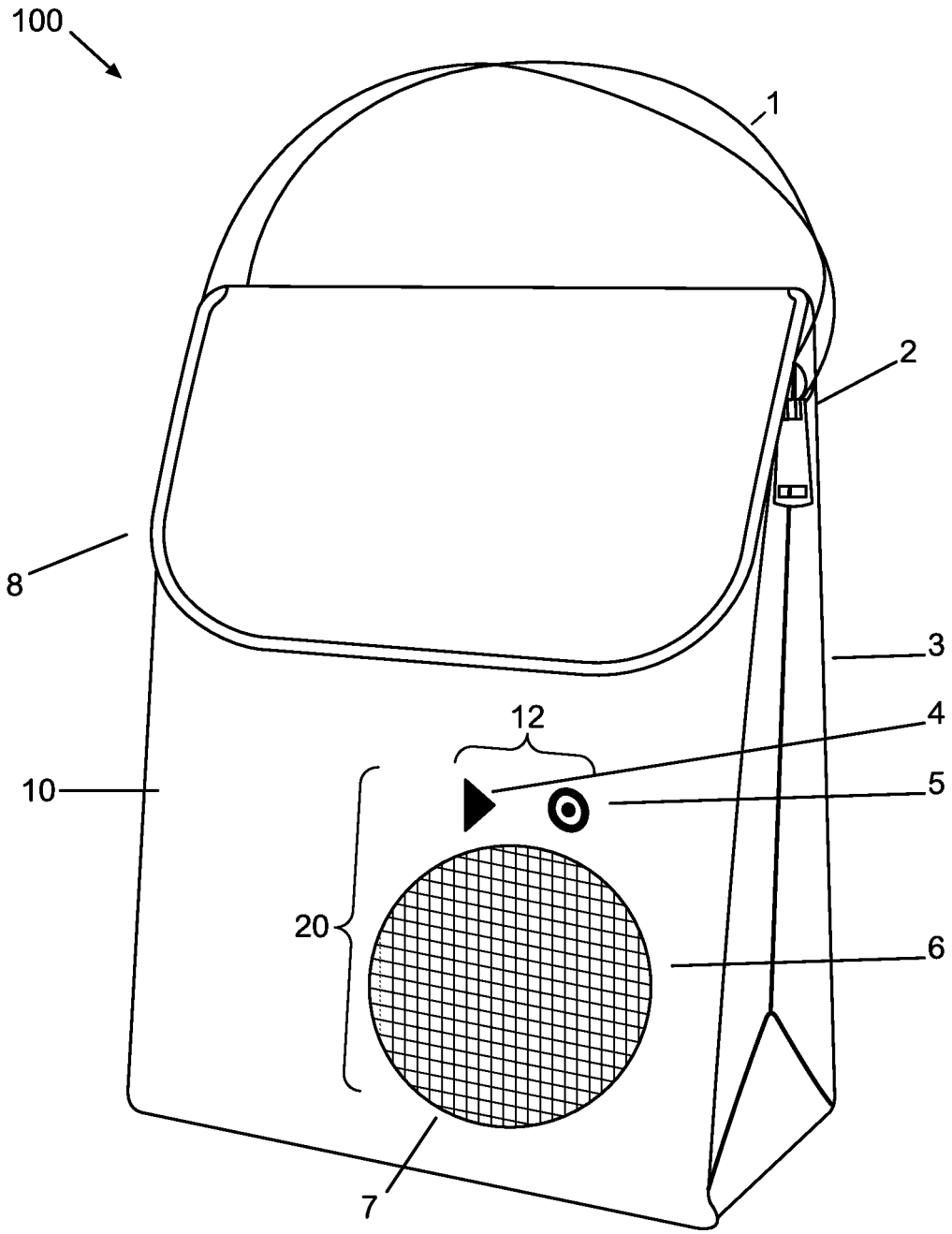
FIG. 2 illustrates another embodiment of the food container of the present disclosure.
Figure 3:
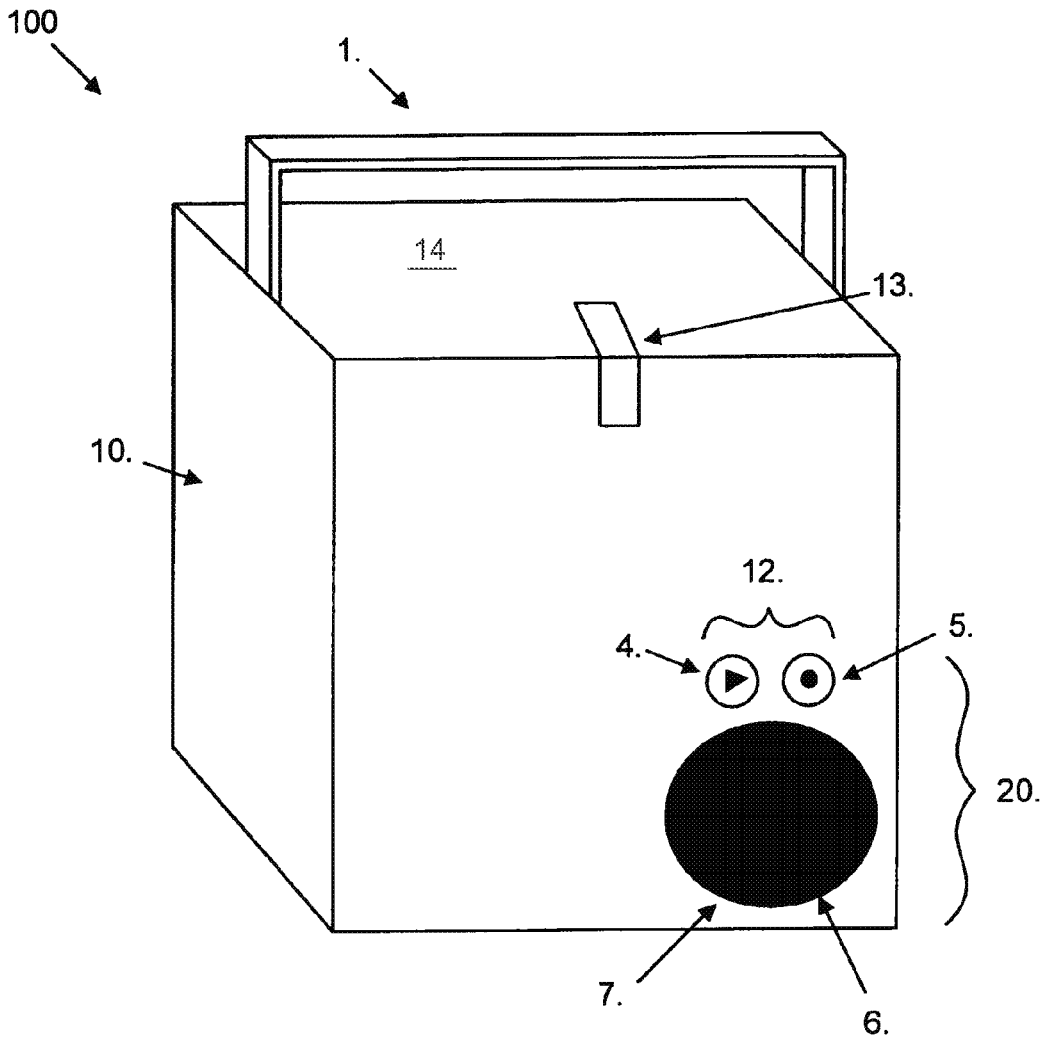
FIG. 3 illustrates a further embodiment of the food container of the present disclosure.

Various exemplary embodiments of a food container 100 of the present disclosure are illustrated in FIGS. 1-3. The food container includes a media player 20 configured to play media content. The media player 20 includes an output device, such as speaker 6, for outputting media content including audio content. In another embodiment, the output device comprises a plug into which a jack for earphones or headphones may be inserted. The output device may or may not be part of the media player. For example, the speaker 6 may be included with the container separate from, but connected to, the media player. If the output device is a speaker 6, located on the exterior of the food container 100, it may be covered by a mesh 7 for protection against damage. The output device can also be a wireless device for transmitting the media content to another device, such as a smartphone for play back of the selected media content. The wireless transmission can, for example, be via a Bluetooth® connection or other wireless transmission system between the media player and the another device.

The media player 20 plays media content. In one embodiment, the media content can include audio content in one of variety of digital formats including, but not limited to, MPEG-1 Audio Layer II (MP2), MPEG-1 Audio Layer III (MP3), Waveform Audio Format (WAV), or Windows Media Audio (WMA), for example. In some embodiments, the media player 20 further comprises an audio recorder including a microphone (not shown). In one embodiment, the media content is a message from the parent or other meal maker to the person having the food container for the day.

Also, in the embodiments illustrated in FIGS. 1-3, the food container 100 includes one or more devices 12 for operating the media player 20 that may be accessible on the exterior of the food container 100, but may also be located in the interior of the food container 100. Specifically, the illustrated food container 100 includes a play button 4 and a record button 5. In some embodiments, the device 12 is an input/output device that allows one to select media content for play later and also allows one to active the play of the selected media content using the same device. In other embodiments, device 12 includes separate media content input and activation devices, such as illustrated in FIG. 1A. In yet other embodiments, device 12 includes one or more buttons such as a play button, a record button, a volume button, a pause button, a power button, a fast forward button, a reverse button, a stop button, a next-track button, a previous-track button, scroll wheel, erase button, and one or more of a variety of other buttons. In other embodiments, the container and/or the media player 20 may include and employ voice recognition software to recognize spoken commands to operate the media player 20.

In some embodiments, the playback of the media content is triggered by a play button 4. However, in other embodiments, the food container 100 plays the media content when a lid of the container 100 has been opened or the closure means of the main compartment of the container has been opened. In those embodiments, the food container further includes a sensor adapted to detect the opening of the lid or closure means of the container and activate the playback of the media content. In yet other embodiments play of the media content is activated by a timer by which a parent or other meal maker can set a time at which the media player will be activated to play selected media content, such as during the meal time of the person having the container.

As can be seen in FIGS. 1-3, the food container 100 may include a handle 1. In other embodiments, the food container 100 includes one or more handles, straps, and/or other carrying means. Further, in some embodiments, the food container 100 is a lunch bag or box.

Additionally, in some embodiments, such as the one illustrated in FIGS. 1A-1C, the food container 100 includes multiple compartments 3, 10. For example, the food container 100 includes a front compartment 3 in addition to the main compartment 10. Further, in the embodiment illustrated in FIGS. 1A-1C, the media player 20 is housed within this front compartment 3, except for the media content output device 6 and input selector/activation device or devices 12, which are accessible through the exterior of the front compartment 3. Thus, the media content output device 6 and input selector/activation device or devices 12 are on the exterior of the food container 100, which includes at least a portion of the exterior of the front compartment 3. In some embodiments, the front compartment 3 can be waterproof and can further include a waterproof seal. The front compartment can be sealed or may be resealable. By having the media player 20 enclosed in the front compartment 3 in this manner, the media player 20 is protected from leaks or other contamination from food or liquids stored in the main compartment 10. The front compartment 3 can also be thermally insulated and/or padded to provide further protection for media player 20. Further, the main compartment 10 can also be waterproof and/or thermally insulated as well.

Additionally, the food container 100 may include one or more of a variety of closure means for closing the compartments. For example, in the embodiment illustrated in FIGS. 1A-1C, the compartments 3, 10 are closed by zippers 2, 8. Similarly, in FIG. 2, the lunch bag 100 includes a fold-over flap 8 that includes a closure such as a snap or Velcro closure in place of lid 11. The fold-over flap may cover or conceal a zipper closure or other type of closure located along the top edge or side of the container. Likewise, in FIG. 3, the food container 100 includes a latch 13 for top 14. Additionally, the device 12 and output device 6 are on the exterior of the food container 100, and the exterior of the food container 100 includes at least a portion of the exterior of the main compartment 10.

Figure 4:
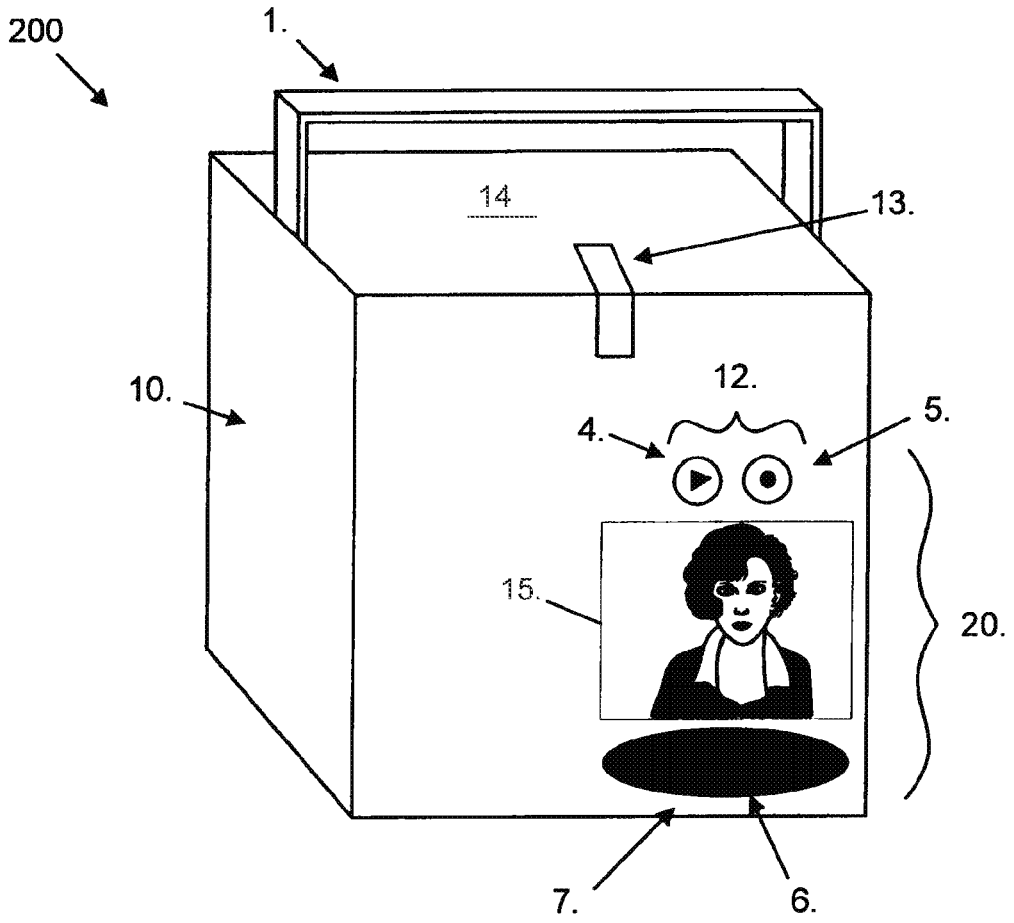
FIG. 4 illustrates an embodiment of the food container of the present disclosure in which the media player includes a display for displaying media content including video content.

FIG. 4 illustrates an embodiment of a food container 200, which is similar to the embodiments illustrated in FIGS. 1-3, except in FIG. 4 the food container 200 also includes a display 15 for displaying media content including video content. In the embodiment illustrated in FIG. 4, the display 15 is located on the exterior of the food container 200. The display 15 can include a computer monitor, a plasma screen, a liquid crystal display (LCD) screen, DTV/HDTV screen, touchscreen, electronic ink screen, or one of a variety of other display screens. In some embodiments, the food container 200 further includes a video recorder that is, for example, a digital camcorder that receives and records video content for playback. Also, in some embodiments, the food container 200 includes a projector that is capable of projecting a digital image or video content onto a surface for viewing.

It should be noted that the video content may be in any of a number of formats including, but not limited to, Motion Picture Experts Group (MPEG)-1, MPEG-2, MPEG-4, H.264, VC-1, Third Generation Partnership Project (3GPP), 3GPP-2, Standard-Definition Video (SD-Video), High-Definition Video (HD-Video), Digital Versatile Disc (DVD) multimedia, Video Compact Disc (VCD) multimedia, High-Definition Digital Versatile Disc (HD-DVD) multimedia, Digital Television Video/High-definition Digital Television (DTV/HDTV) multimedia, Audio Video Interleave (AVI), Digital Video (DV), QuickTime (QT) file, Windows Media Video (WMV), Advanced System Format (ASF), or any number of other digital video formats.

In some embodiments, the display outputs digital images, such as photos, like an electronic picture frame. The image files may be in any of a number of formats including, but not limited to, Joint Photographic Experts Group (JPEG) files, Tagged Image File Format (TIFF) files, Portable Network Graphics (PNG) files, Graphics Interchange Format (GIF) files, bitmap (BMP) files, and one or more of a variety of other digital image formats.

Additionally, in some embodiments, the display 14 outputs a menu that allows a user to select one or more of a variety of options. Also, the display 14 may display a text message as well. In some embodiments, the media player 20 includes a clock feature that displays the time and/or date on the display 14. Further, the media player 20 may also include an alarm clock or timer feature such that the media content will be played at a certain time without input from the person eating food from the container.

Figure 5:
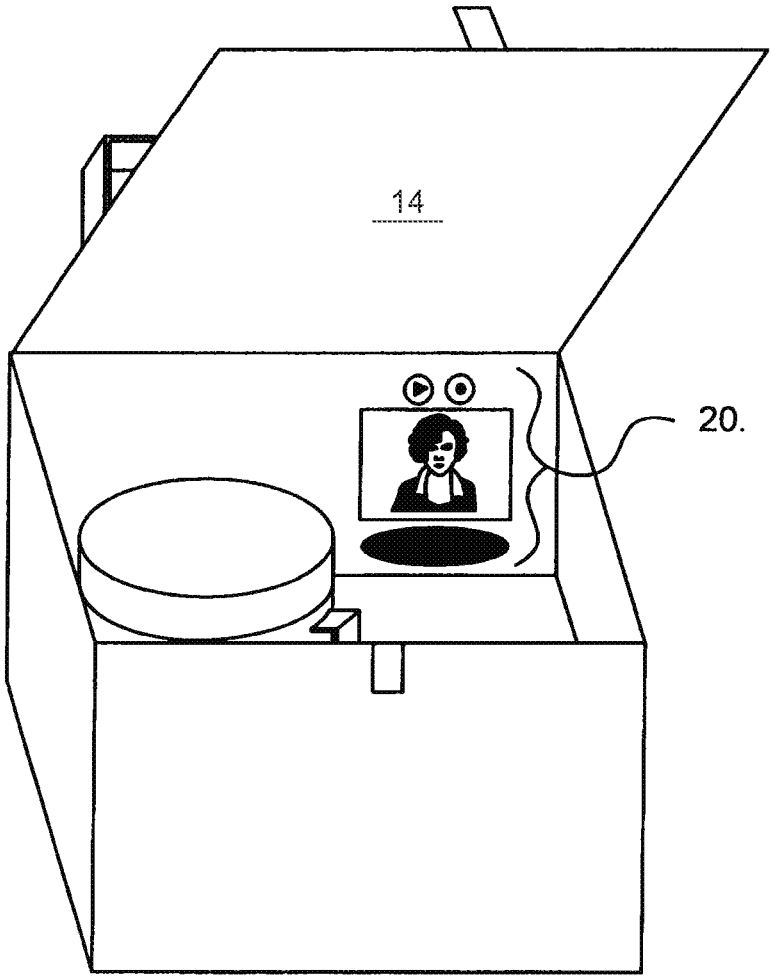
FIG. 5 illustrates an alternative embodiment of the food container of FIG. 4.

FIG. 5 illustrates an embodiment similar to the embodiment illustrated in FIG. 4, except that in FIG. 5 the food container 300 includes the media player 20 placed inside the main compartment of the container 300. By including the media player 20 in the main compartment 10, the media player 20 can be observed with more privacy by a meal eater.

Figure 6:
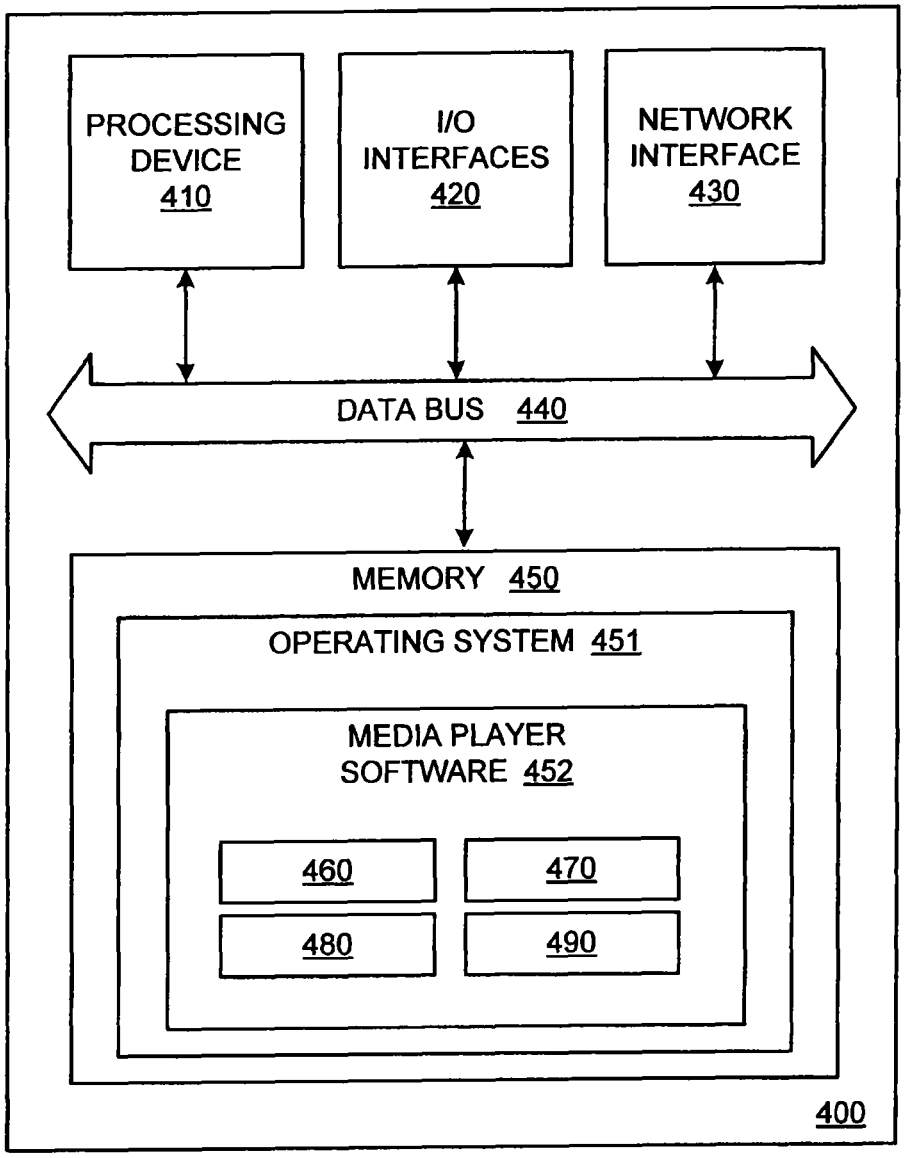
FIG. 6 is a block diagram illustrating an exemplary computing device for the media player of the present application.

The media player 20 of the embodiments of the food containers illustrated in FIGS. 1-5 further includes an operating device and system. FIG. 6 is a block diagram illustrating a non-limiting example of a suitable operating device and system device 400. The device 400 in FIG. 4 includes a processing device 410, I/O interfaces 420, a data bus 440, and a memory 450. The processing device 410 is configured to execute software stored in an operating system 451, including media player software 452. In some embodiments, the operating device 400 further includes a network interface 430 for embodiments where the media player 20 is in communication with other devices over a network.

The processing device 410 includes a custom-made or commercially-available processor, a central processing unit (CPU), an auxiliary processor among several processors, a semiconductor based microprocessor (in the form of a microchip or chip set), a macroprocessor, and/or generally any device for executing software instructions. When the media player 20 is in operation, the processing device 410 executes the media player software 452, communicates data to and from the memory 450 over the data bus 440, and generally controls the operation of the media player 20 pursuant to the media player software 452.

The I/O interfaces 420 provide any number of interfaces for the input to and output of data from the media player 20. Data may be sent to and/or from the media player 20 to and/or from the audio recorders, video recorders, a speaker 6, display 15, and/or one or more input buttons 12, for example.

The network interface 430 includes various components used to transmit and/or receive data over a network. For example, the network interface 430 includes a device that communicates both input data and output data, for example, a modulator/demodulator (e.g., a modem), wireless (e.g., radio frequency (RF)) transceiver, a telephonic interface, a bridge, a router, network card, etc.). The network includes a Public Switched Telephone Network (PSTN), a Mobile Telephone Network, the Internet, a Local Area Network (LAN), a Wide Area Network (WAN), and/or other networks.

The memory 440 may include any one of a combination of volatile memory elements (e.g., random-access memory (RAM), such as DRAM, and SRAM, etc.)) and/or nonvolatile memory elements (e.g., read-only memory (ROM), hard drive, tape, etc.). The memory 440 includes the operating system 451 as well as one or more applications, emulation systems, or emulated applications for any of a variety of operating systems and/or emulated hardware platforms, emulated operating systems, etc. For example, the applications stored in the operating system 451 include the application specific program 452, which may include instructions for operating the media player 20. One of ordinary skill in the art will appreciate that the memory 450 can, and typically will, comprise other components, which have been omitted for purposes of brevity. In some embodiments, detachable memory, such as a thumb drive (i.e., removable flash memory) is inserted into the media player 20 having a USB port or a memory card is inserted in the media player 20, and the detachable memory is accessible to the media player using the I/O interfaces 420.

In some embodiments, the media player software 452 is stored on a variety of computer-readable media for use by, or in connection with, a variety of computer-related systems or methods. In the context of this disclosure, a "computer-readable medium" stores, communicates, propagates, or transports the program for use by or in connection with the instruction execution system, apparatus, or device. The computer readable medium can be, for example, but not limited to, an electronic, magnetic, optical, electromagnetic, infrared, or semiconductor system, apparatus, or device. More specific examples (a non-exhaustive list) of the computer-readable medium may include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), a portable compact disc read-only memory (CDROM) (optical), a digital versatile disc (optical), a high definition digital versatile disc (optical), and a Blu-ray Disc (optical).

The media player software 452 includes an input receiving module 460, a recording module 470, and a operation module 480, which operates the media player 452 based on inputs received from the input receiving module 460. The input receiving module 460 receives inputs from one or more of a variety of input means including, but not limited to, a depression of an input button 12, a personal computer in communication with the media player 20, and/or a sensor responsive to an opening of a lid or flap of the food container. In some embodiments, the media player 452 further includes a communication module 490 for controlling the communication between the food container and another device, such as a personal computer.

In some embodiments, a user is able to select or record the media content on a personal computer and transfer the media content to the food container. For example, some embodiments include application specific software that can be downloaded to the personal computer of a user, and the application specific software is configured to receive selections or recordings from a user and then cause the personal computer to transmit them to the food container. The recordings can then be received by the food container, which is configured to be in communication with the personal computer over a cable connection or network. For example, the food container may be in communication with the personal computer via cable, which may be any number of common computer interface cables, such as, but not limited to IEEE-1394 High Performance Serial Bus (Firewire), Universal Serial Bus (USB), optical fiber, a serial connection, or a parallel connection. In some embodiments, the food container is coupled to the personal computer over a WiFi connection (IEEE 802.11), Bluetooth connection, or other wireless communication path.

Alternatively, the user could use a personal computer, without application specific software, to record the media content, save the media content to a thumb drive (including flash memory) inserted into a USB port of the computer, remove the thumb drive, and insert the thumb drive into the media player in the food container.

It should be emphasized that the above-described embodiments in the present disclosure are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

The invention claimed is:

1. A food container having an exterior, the food container comprising:

at least one compartment sized and dimensioned to accommodate food;

a second compartment for housing a media player, the second compartment being waterproof and having a resealable closure;

at least one device accessible from the exterior of the food container and connected to the media player, wherein the at least one device serves as an input device to activate the play of media content from the media player; and an output device that serves to output media content activated for play from the media player.

2. The food container of claim 1, wherein the at least one device comprises an input device to select media content in a media player and a separate activation device to activate the play of the selected media content.

3. The food container of claim 1, wherein the media player includes a media recorder and the at least one device that serves as an input device includes a device for activating the recording of media content on the media player.

4. The food container of claim 3, further including a microphone configured for connection to the media player for recording a message for playback.

5. The food container of claim 3, wherein the media content is a recorded message.

6. The food container of claim 1, wherein the second compartment is thermally-insulated.

7. The food container of claim 1, wherein the at least one compartment is thermally insulated.

8. The food container of claim 1, wherein the output device is selected from the group consisting of a speaker, a jack for earphones or headphones, a wireless output, and combinations thereof.

9. The food container of claim 1, wherein the media player includes a selection of voices and the input device can be used to select a voice from the selection of voices.

10. The food container of claim 1, wherein the food container is a soft-sided, thermally insulated food container.

11. The food container of claim 1, wherein the at least one device comprises a sensor to activate play of the media player upon movement of a flap.

12. The food container of claim 11, wherein the flap is a lid or a closure for the at least one compartment.

13. The food container of claim 1, further comprising an alarm.

14. The food container of claim 1, further comprising a display for displaying video media content.

15. The food container of claim 14, further comprising a media recorder on which video media content can be recorded for playback.

16. The food container of claim 1, further including a timer to activate the play of media content at a pre-selected time.

* * * * *